United States Patent [19]

Lorscheid et al.

[11] 4,278,360

[45] Jul. 14, 1981

[54] CONTAINER FOR STORING AND METERING LIQUIDS

[75] Inventors: Willy Lorscheid, Pulheim; Ludwig Wingen, Cologne, both of Fed. Rep. of Germany

[73] Assignee: Joachim Czech, Donaustauf, Fed. Rep. of Germany

[21] Appl. No.: 40,500

[22] Filed: May 21, 1979

[30] Foreign Application Priority Data

Jun. 23, 1978 [DE] Fed. Rep. of Germany ..... 2827585

[51] Int. Cl.[3] ..... B43K 5/10

[52] U.S. Cl. ..... 401/151; 141/18; 141/31; 141/381

[58] Field of Search ..... 401/120, 124, 130, 151, 401/187, 196, 202, 262; 141/18, 31, 380, 381; 128/222, 213 R

[56] References Cited

U.S. PATENT DOCUMENTS

| | | | |
|---|---|---|---|
| 2,311,367 | 2/1943 | Chambers | 401/151X |
| 2,949,622 | 8/1960 | Clement | 401/151 X |
| 3,195,544 | 7/1965 | Politzer | 401/130 X |
| 3,229,866 | 1/1966 | Arbitman et al. | 401/151 X |
| 3,369,854 | 2/1968 | Ferris | 401/120 X |
| 4,035,090 | 7/1977 | Bavaveas | 401/202 X |

*Primary Examiner*—Edward M. Coven
*Attorney, Agent, or Firm*—James E. Nilles

[57] ABSTRACT

This invention relates to a container having a reservoir for storing a liquid and an intermediate storage space communicating with said reservoir and adapted to receive liquid therefrom on generation of a vacuum therein. Communication between reservoir and intermediate storage space is through a capillary tube having an inside diameter small enough so that a column of liquid is maintained therein whenever pressures in said reservoir and storage space are substantially equal, but large enough so that liquid flows into the storage space when pressure therein is lower than in the reservoir. The closure for the container comprises a piston which, as the container is opened, moves out of the storage space to create a vacuum therein.

1 Claim, 6 Drawing Figures

CONTAINER FOR STORING AND METERING LIQUIDS

BACKGROUND OF THE INVENTION

This invention relates to a container having a reservoir for storing a liquid and an intermediate storage space communicating with said reservoir and adapted to receive liquid therefrom on generation of a vacuum therein.

For packing of fluid products there are already known miniature containers suitable for economical mass-production by injection molding. In the case of liquid products such as liquid pharmaceuticals, cosmetic products, including shaving lotions, detergents, herbicides and insecticides etc. it is generally required or desirable to dispense these products in metered amounts. In the case of conventional containers provided for instance with a screw-cap closure, metering of the liquid may be performed by dropwise dispensing or by using the closure cap itself as a metering cup to be filled with the product from the packing container.

Also known are containers for dispensing sticks, such as deodorant sticks, comprising a screw cap closure, with a seal located between the interior circumferential surface of said screw cap and the adjacent outer circumferential surface of the container, such seal being effective when the screw cap is being screwed off and on. Within the container, the dispensing stick abuts a piston slidably supported in the container in communication with atmospheric pressure through the open lower end of the container. When the screw cap closure is screwed off, the seal causes a vacuum to be generated in the interior of the screw cap, whereby the dispensing stick is pulled or pushed out of the container due to the atmospheric pressure acting on the piston. Prior to each use, the dispensing or product stick is thus pulled out of the container by a predetermined amount for compensating the consumption of the product stick during each use thereof.

SUMMARY OF THE INVENTION

It is an object of the invention to provide an improved container of the type defined in the introduction adapted for reliably dispensing a metered amount of the liquid packed in the container in a simple manner.

In accordance with the invention, this object is achieved by a container of the type defined in the introduction, wherein the intermediate storage space communicates with the reservoir via a capillary tube the dimension of which is adapted to the viscosity of the liquid such that the liquid flows from the reservoir only when the pressure in the intermediate storage space is lower than in the reservoir.

With the aid of the capillary tube opening into the intermediate storage space, the vacuum created therein causes a metered amount of the liquid to be conveyed to the intermediate storage space, the specific amount of the conveyed liquid being dependent upon the magnitude of the vacuum, so that the metered amount may then be dispensed from said intermediate storage space, for instance after opening the container closure.

The vacuum in the intermediate storage space may be created in any manner, e.g. by means of a pump mechanism, or in the known manner by pulling off or unscrewing a container closure. Subsequent replacement of such closure on the container causes an overpressure to be created in the intermediate storage space, such overpressure acting via said capillary tube on the liquid contained in the reservoir so as to equalize the pressure therein. While the transfer of a determined liquid amount from the reservoir to the intermediate storage space of the container causes a certain vacuum to be created in the air space above the liquid in the reservoir, closing of the container closure causes the pressure within the reservoir to be equalized, since the overpressure created thereby in the intermediate storage space escapes to the reservoir by way of the capillary tube.

In the container according to the invention, the capillary tube thus acts as a valve permitting a metered amount of the liquid to be transferred to the intermediate storage space under the effect of a vacuum created therein, and preventing any further liquid to flow from the reservoir for instance after opening of the container closure and the elimination of the vacuum in the intermediate storage space caused thereby. On the other hand, the capillary tube acting as a valve permits any overpressure to escape from the intermediate storage space to the reservoir, so that the air compressed in the intermediate storage space as by closing the container closure may flow via the capillary tube to the liquid reservoir in order to replenish the air volume contained therein. The container according to the invention does thus not require a piston acted on by atmospheric pressure through an opening in the lower portion of the container.

In accordance with a specific embodiment of the invention set forth in the subclaims, the intermediate storage space may contain a pad to be impregnated with the dispensed amount of metered liquid or may be formed as a metering container.

In a metering chamber configuration of the intermediate storage space the container closure may have connected thereto a metering piston adapted on opening of the container closure to evacuate the volume it occupies within the metering chamber, and on closing of the container closure, to displace the free volume within the metering chamber.

THE DRAWINGS

Embodiments of the invention are shown in the accompanying drawings, in which:

FIG. 1 shows a first embodiment of the container with the intermediate storage space formed as a metering chamber, FIG. 2 shows the embodiment of FIG. 1 with a metering piston projecting deeply into the metering chamber, FIG. 3 shows a portion of the container of FIG. 1 with a closure cap removed, FIG. 4 shows the removed closure cap of the embodiment of FIG. 1, FIG. 5 shows a second embodiment of the container in its closed state, wherein the intermediate storage space contains an impregnable pad, and FIG. 6 shows the embodiment of FIG. 5 with the closure cap removed.

DESCRIPTION OF A PREFERRED EMBODIMENT

Figure 1:
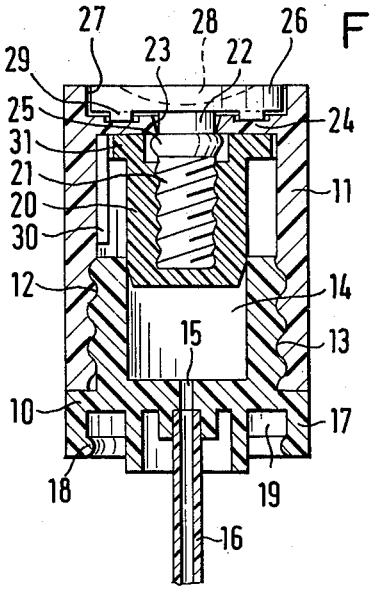
Figure 4:
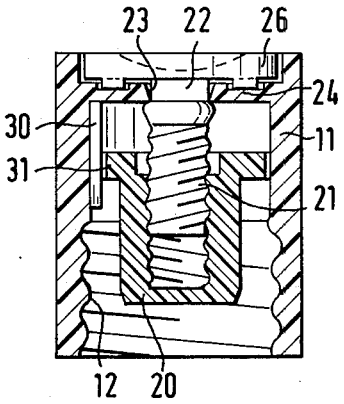

The only partially shown container has a head member 10 and a cup-shaped closure cap 11 formed with interior threads 12 for engagement with outer threads 13 of the head member. Head member 10 and closure cap 11 are both injection molded of plastic material.

Head member 10 includes an upwardly opening cylindrical metering chamber 14 which comprises an intermediate storage space. The head member 10 is provided at its bottom with an opening 15 for connection of the metering chamber 14 to a thin plastic tube 16 formed as a capillary tube and extending into the liquid-containing reservoir portion (not shown) of the container. Integrally formed with head member 10 is an annular collar 17 carrying a radially inwardly projecting annular bead 18. Head member 10 may be snap-fitted to the throat of a plastic bottle or other container, with the throat being received in an annular recess 19 defined by collar 17 and retained therein in a press-fit by annular bead 18.

Provided within closure cap 11 is a cylindrical metering piston 20 likewise formed by injection molding. Metering piston 20 is mounted for axial displacement within closure cap 11 by means of a plastic spindle 21 engaging interior threads of piston 20 and having a non-threaded portion 22 extending through an opening 23 in the end wall or top wall 24 of the inverted cup-shaped closure cap 11. Formed integrally with spindle 21 between the threaded and the non-threaded portions thereof is an annular bead 25 engaging the underside of top wall 24 so as to retain the spindle in an axially fixed position within closure cap 11. Integrally connected to spindle 21 is a flat rotary turning knob 26 received in a correspondingly shaped recess 27 in the outer side of top wall 24 and serving to rotate spindle 21. To this effect knob 26 may be provided with a slot 28 for insertion of a coin or the like as a turning tool. At its underside knob 26 has an annular sealing and locating rib 29 engaging a correspondingly shaped annular groove in the bottom of recess 27 in the top of the closure cap. Metering piston 20 is sealingly guided in metering chamber 14.

For mounting spindle 21 it is pressed from outside through opening 23 so that its annular bead 25 comes into snap-fit engagement with the inner side of top wall 24 to hold the two parts firmly together. Subsequently the metering piston 20 is screwed onto spindle inside of the closure cap. Metering piston 21 is provided with a collar 31 for engagement with an axial key member 30 formed on the cylindrical interior wall surface of the closure cap for preventing rotation of the metering piston in the manner of a groove and spline connection. Metering piston 20 is thus non-rotatably connected to closure cap 11 whilst being axially adjustable.

FIG. 1 shows the container closure with the metering piston 20 adjusted to its upper limit position, in which the lower conical end portion of the piston extends to a small extent only into metering chamber 14. In this position of the piston there occurs no metered dispensing of liquid.

Figure 2:
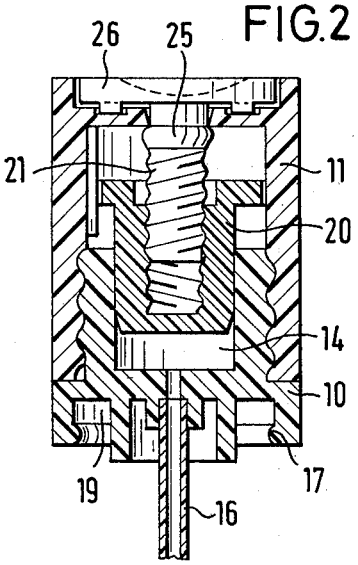
Figure 3:
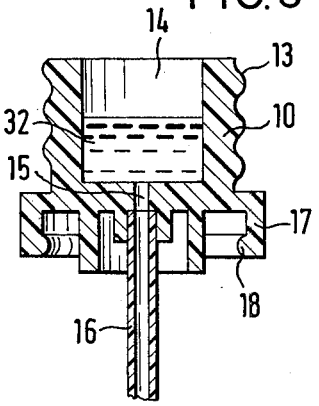

In FIG. 2 the metering piston 20 has been lowered to such an extent that it will penetrate rather deeply into metering chamber 14 when closure cap 11 is screwed down completely. If closure cap 11 is then unscrewed and pulled off head member 10, metering piston 20 sucks a liquid amount corresponding to its displacement volume from the container into metering chamber 14 via dip tube 16 formed as a capillary tube. After removal of closure cap 11, metering chamber 14 now contains an amount of liquid determined by the depth of penetration of the metering piston as shown at 32 in FIG. 3. The volumetric amount may thus be selectively adjusted within predetermined limits by axial adjustment of metering piston 20 with the aid of spindle 21 and turning knob 26. When the closure cap 11 is screwed back onto head member 10 the plug-shaped metering piston 20 penetrates into metering chamber 14. The air displaced by this action can escape into the container via capillary tube 16 so as to achieve pressure equalization. The portion of head member 10 surrounding metering chamber 14 may be formed as a pouring spout. The top surface of closure cap 11 may advantageously be provided with markings indicating the angular position of turning knob 27 and thus the respective adjusted position of metering piston 20, i.e. the effective metering amount.

As pointed out hereinabove, the inside diameter of the capillary tube 16 is related to the viscosity of the liquid that is to be dispensed, and must be small enough to ensure that a capillary effect will occur. This is to say that the inside diameter of the tube 16 should not be so large that surface tension effects of the liquid within the tube are insignificant, and should be small enough so that, with equal pressures in the reservoir portion of the container and in metering chamber 14, there will be in the tube 16 a column of liquid above the level of the liquid in the reservoir portion. However, the inside diameter of tube 16 must be large enough for liquid to flow between the reservoir portion and the metering chamber 14 when there is a pressure difference between them. In this connection it can be pointed out that the height of liquid in a capillary tube, above the level of liquid in which the tube is immersed, is known to be given by:

$$Z=2T/jR$$

where Z is the height of the column above the fluid level, T is the capillary constant of the liquid under consideration (which depends upon the surface tension of the liquid), j is the specific weight of the liquid, and R is the inner radius of the tube.

Thus, when pressures at the opposite ends of the tube 16 are equal, the column of liquid in the tube serves as a "capillary stopper" whereby liquid is prevented from flowing into both the metering chamber 14 and the reservoir portion, regardless of the position or orientation of the container, and said column of liquid also forms a ready reserve from which liquid flows immediately into the metering chamber 14 when the pressure therein is reduced below pressure in the reservoir portion, thus ensuring that the quantity of liquid issuing into the metering chamber 14 when suction is created therein will be substantially equal to the effective increase in volume of that chamber that created the suction In the second embodiment shown in FIGS. 5 and 6, parts corresponding to those of the preceding embodiment are designated by the same reference numerals.

In this embodiment, head member 10 contains an intermediate storage means in the form of an impregnable pad 33 formed for instance of foam rubber with outwardly opening pores. Head member 10 again has an opening 15 for connection to a capillary tube 16 opening into the head member and thus also into the pad. Also in this embodiment, closure cap 11 is provided with interior threads 12 for engagement with exterior threads 13 of head member 10 or at the upper portion of the container. Located between the interior circumferential surface of closure cap 11 and the adjacent exterior circumferential surface of the container is a sealing lip 34 for sealing the interior of the closure cap from the surrounding atmosphere during unscrewing and screwing down of the closure cap over a predetermined distance, so that unscrewing of the closure cap causes a vacuum to be created in known manner within its interior containing pad 33, and screwing down of the closure cap causes an overpressure to be created therein.

Analogously to the first embodiment shown in FIGS. 1 to 4, unscrewing of the closure cap 11 thus causes a predetermined amount of liquid to be transferred from the reservoir space 35 of the container to the pad so as to impregnate it with the liquid. After complete removal of closure cap 11, this liquid amount may be transferred from the pad to an object to be treated by passing the pad over the said object.

On threading down of the closure cap 11, sealing lip 34 causes an overpressure to be created in the interior of closure cap 11, whereby air is pressed into reservoir space 35 via capillary tube 16, so that the air volume contained in the reservoir space 35 above the liquid is replenished in accordance with the previous amount of liquid dispensed therefrom.

Figure 5:
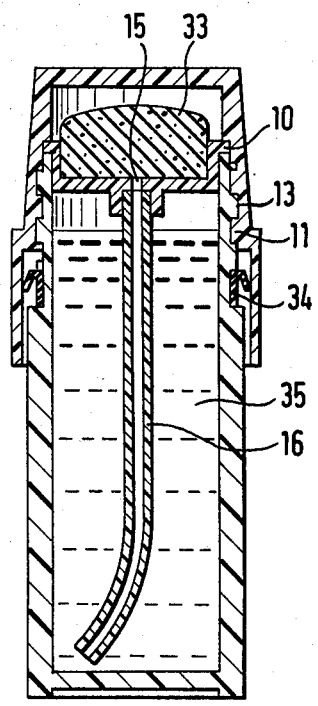
Figure 6:
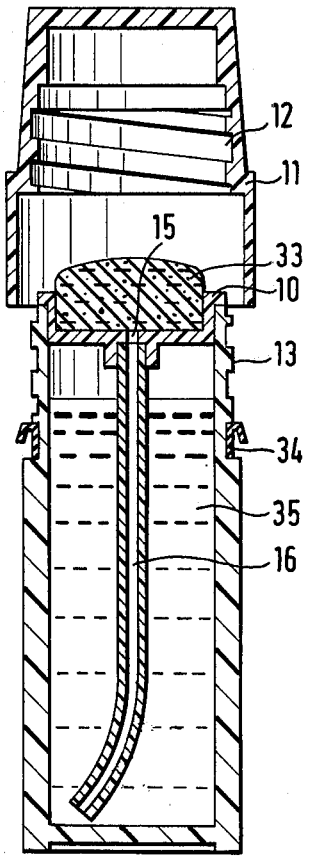

As evident from FIGS. 5 and 6, the container does not require a piston guided within the container, which would have to be acted on by atmospheric pressure via an opening in the lower portion of the container.

The container not shown in connection with the embodiment of FIGS. 1 to 4 may of course be of the same type as the container shown in FIGS. 5 and 6.

I claim:

1. A container having a reservoir for storing liquid and an intermediate storage space of variable volume which is above the reservoir and communicated therewith and into which liquid from the reservoir can be drawn by increasing the volume thereof to produce a vacuum therein, said container being characterized by:

(A). a tube having a lower end near the bottom of the reservoir and having an upper end opening to said intermediate storage space to communicate said space with the reservoir, said tube having an inside diameter so related to the viscosity of liquid in the reservoir as to be (1) small enough for a column of liquid to be present in said tube at substantially all times when pressure in said intermediate storage space is equal to pressure in the reservoir, and (2) large enough for liquid to flow into said intermediate storage space when pressure therein is lower than pressure in the reservoir;

(B). the portion of the container that defines said intermediate storage space comprising an upper side wall having a substantially cylindrical inner surface and a threaded external surface;

(C). an inverted-cup-shaped closure cap for said container having a side wall that is internally threaded for engagement with said threaded external surface and having an end wall;

(D). a piston having a cylindrical surface that can sealingly oppose said inner surface of the upper side wall, said piston being cooperable with said side wall to close the top of the intermediate storage space and to vary the volume thereof; and (E). means providing a coaxial, substantially rigid, axially adjustable connection between the piston and said end wall of the closure cap whereby the piston, in every position of its adjustment relative to said cap, is constrained to partake of axial motion of said cap, so that upon installation and removal of said cap the piston decreases and increases, respectively, the volume of said storage space by an amount that depends upon the position of axial adjustment of the piston relative to said cap.

* * * * *